United States Patent [19]

Boettger et al.

[11] 4,203,336

[45] May 20, 1980

[54] PUNCH CHANGE MECHANISM FOR A DOUBLE PRESSURE PIN PRESS

[75] Inventors: Friedrich Boettger, Haan; Walter Eugster, Ratingen; Walter Lenssen; Bodo Missmahl, both of Dusseldorf, all of Fed. Rep. of Germany

[73] Assignee: Malmadie & Co. Maschinenfabrik GmbH, Dusseldorf, Fed. Rep. of Germany

[21] Appl. No.: 946,183

[22] Filed: Sep. 27, 1978

[30] Foreign Application Priority Data

Nov. 11, 1977 [DE] Fed. Rep. of Germany ..... 2750536

[51] Int. Cl.[2] ..... B26F 1/02

[52] U.S. Cl. ..... 83/550; 83/556; 83/618

[58] Field of Search ..... 83/550, 551, 618, 552, 83/549, 556; 173/50

[56] References Cited

U.S. PATENT DOCUMENTS

| | | | |
|---|---|---|---|
| 1,163,116 | 12/1915 | Stiggins | 83/550 X |
| 3,720,127 | 3/1973 | Michelson | 83/550 |

*Primary Examiner*—Frank T. Yost

[57] ABSTRACT

There is disclosed a punch change mechanism for a double pressure pin press or the like having a reciprocating press carriage and a punch holder plate swingably mounted thereon. The punch holder plate is driven by plate cams rotated by the main drive for the press through a gear train. The gear train includes a driven elongated first spur gear mounted on fixed structure against axial movement with respect thereto, and a second spur gear rotatably mounted on the carriage for reciprocation therewith parallel with the axis of the first spur gear and in constant mesh therewith, the second spur gear being fixedly connected to a shaft journalled on the carriage and having the cam plates fixedly mounted thereon.

8 Claims, 2 Drawing Figures

PUNCH CHANGE MECHANISM FOR A DOUBLE PRESSURE PIN PRESS

The invention relates to a punch change mechanism for a double pressure pin press or the like having a reciprocating press carriage and a punch holder plate mounted thereon for movement with respect thereto. The punch holder plate is driven by plate cams rotated by the main drive for the press through a gear train, the punch holder plate having cam followers connected thereto and cooperating with respective plate cams fixedly connected to a drive shaft journalled on the carriage for reciprocation therewith.

BACKGROUND OF THE INVENTION

In West German Pat. No. 1 527 465, there is disclosed a double pressure pin press having a reciprocating press carriage on which a punch carrier is swingably mounted, the punch carrier being oscillated by rotatable cam plates which cooperate with respective cam followers affixed to the punch carrier. The drive train to the cam plates includes a splined shaft disposed parallel to the direction of reciprocation of the carriage and reciprocable therewith, the plined shaft fitting within a complementarily splined sleeve which forms a part of one bevelled gear of a bevel gear set, such sleeve being fixed against axial movement.

In Austrian Pat. No. 132 512 there is disclosed a double pressure pin press having a reciprocating press carriage, the carriage bearing a punch carrier which is reciprocated in a direction normal thereto by diametrically opposed cam followers cooperating with a rotatably driven cam. The drive train for the rotatable cam includes a splined shaft and sleeve combination which is generally similar to that of German Pat. No. 1 527 465.

French Pat. No. 1,245,043 discloses a double pressure pin press having a reciprocating press carriage on which a punch carrier is swingably mounted. In this instance the cams for oscillating the swingable punch carrier are mounted on a fixed structure, connection between the cam followers which cooperate with such cams and the swingable punch carrier being effected by a link there between having universal joints at its opposite ends. The mechanism of this patent is cumbersome, complicated and expensive.

In both West German Pat. No. 1 527 564 and Austrian Pat. No. 132 512 the mounting for the plate cams and the splined connection in the drive train therefor occupy considerable space. Thus the splined cam shaft is mounted in two bearings on the carriage, and the plate cams have flanges of appreciable width. The splined connection must exceed in length the stroke of the carriage. The total length of the splined shaft requires that it be of a diameter which is larger than would be necessary by reason of torque requirements alone. This means that the dimensions of the bearings surrounding the splined shaft, the hub and the sleeve of the bevelled gear must also be larger. Added to this is the unavoidable wear on the engaging surfaces of the lands of the plined connection which have to take up and transmit the driving forces to the cam. Such wear is at a maximum in the extended or forward position of the carriage when the engaging surfaces of the lands on the splined shaft and the splined sleeve are in driving engagement throughout only a fraction of their splined lengths.

BRIEF DESCRIPTION OF THE INVENTION

The punch change mechanism of the invention has among its objects the provision of an improved, simple mechanism which avoids the known deficiencies, described briefly above, of the prior art by the use of a relatively small number of parts which are strong and wear resistant, the life of the press being increased, and the wear thereof being reduced to a minimum.

The preferred punch change mechanism disclosed herein for a double pressure pin press or the like is applied to a press having a reciprocating press carriage and a punch holder plate swingably mounted thereon. The punch holder plate is driven by plate cams rotated by the main drive for the press through a gear train. The gear train includes a driven elongated first spur gear mounted on a fixed structure against axial movement with respect thereto, and a second spur gear rotatably mounted on the carriage for reciprocation therewith parallel with the axis of the first spur gear and in constant mesh therewith. The second sput gear is fixedly connected to a shaft journalled on the carriage and having the cam plates fixedly mounted thereon. The first spur gear is of such axial length that the second spur gear, which is of smaller axial length than the first spur gear, is always maintained in engagement with the first such gear over the full axial length of its teeth. Further, because of its diameter, the first, elongated spur gear constitutes a very strong component of the cam driving train.

BRIEF DESCRIPTION OF THE DRAWINGS

In the accompanying drawings depicting a preferred embodiment of the punch change mechanism of the invention.

Figure 1:
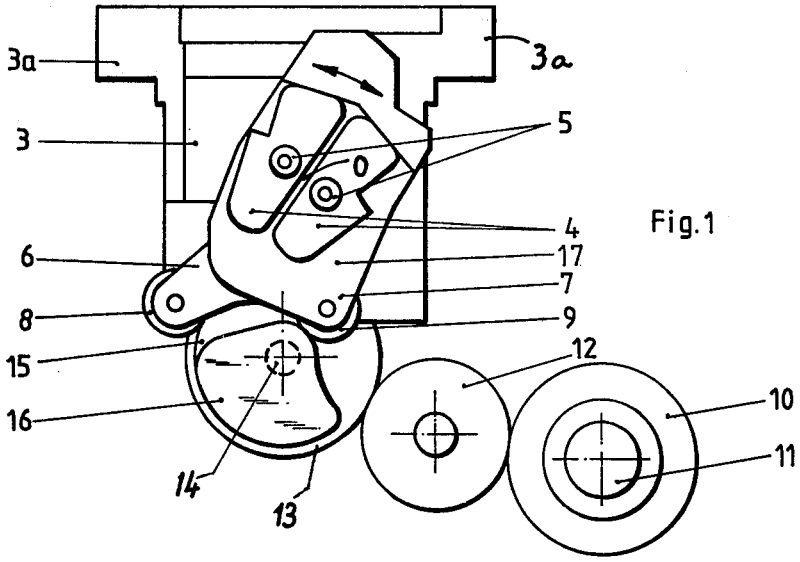
FIG. 1 is a fragmentary view in front elevation of such punch changing mechanism.
Figure 2:
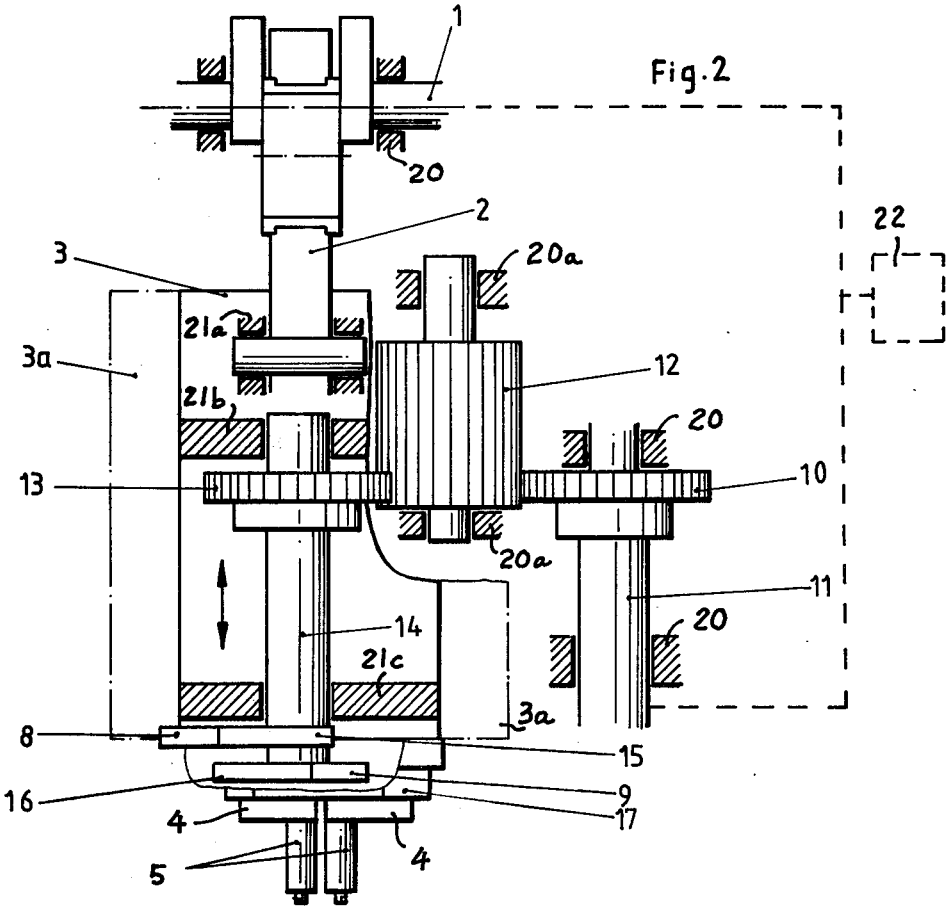
FIG. 2 is a view from the bottom looking upwardly in FIG. 1, certain of the parts being shown in bottom plan and others of the parts being shown in horizontal section.

The illustrative press has a carriage 3 which is reciprocated in a direction into and out of the paper of FIG. 1 and in a vertical direction in FIG. 2 by a driven crankshaft 1 and a connecting rod 2, the lower end of the connecting rod in FIG. 2 being pivotally connected to portions 21*a* of the carriage 3, as shown. The carriage 3 is slidably mounted in guiding means 3*a*. On the front (FIG. 1) and thus the lower end of the mechanism shown in FIG. 2 there is mounted a punch holder plate 17 which is mounted on the carriage 3 by means not specifically shown for oscillation about the axis O as indicated by the curved double-ended arrow in FIG. 1. Punch holders 4 are affixed to the punch holder plate 17, on the arc of a circle having axis O as its center, each punch holder 4 supporting a punch 5. On the under side (FIG. 1) of the punch holder plate 17 there are two bracket-like arms 6 and 7 the outer ends of which journal rollers designated 8 and 9, respectively. As will be seen in FIG. 2, the arms 6 and 7 with their rollers 8 and 9 are arranged one behind the other, i.e. arm 6 with its roller 8 is closer to the carriage 3 than are arm 7 and its roller 9.

The rollers 8 and 9 cooperate with plate cams 15 and 16, respectively, which are fixedly secured to a drive shaft 14 journalled in bearings 21*b* and 21*c* which are affixed to the carriage 3 and reciprocate therewith. The drive shaft 14 is held against axial movement with respect to carriage 3 and reciprocates therewith. As shown in FIG. 1, the drive shaft 14 is driven from a main drive shaft 11 having a gear 10 affixed thereto, gear 10 meshing with a gear 12, which in turn meshes with a gear 13 affixed to the drive shaft 14. The main drive shaft 11 is connected to the crankshaft 1 by means indicated by a dash line in FIG. 2 which ensures synchronism in speed and phase of rotation between the shafts 11 and 1. Shafts 11 and 1 are driven by a prime mover 22.

As shown in FIG. 2, the shaft 11 is journalled in bearings 20 which are fixedly secured to the frame of the machine and retain the shaft 11 from axial displacement. The gear 12 is similarly journalled in bearings 20a which are fixedly secured to the frame of the machine and retain such gear against axial movement. Gear 12 has teeth which extend parallel to the axis thereof; gear 12 is hereinafter termed the "first spur gear". The axial length of gear 12 exceeds the length of stroke of the carriage 3. A "second spur gear" 13, affixed to drive shaft 14, has a much smaller axial length than gear 12. The relationship between the axial lengths of gears 12 and 13 is such that throughout the entire reciprocal travel of the carriage 3, which is shown in its forward-most advanced position in FIG. 2, the gear 13, which reciprocates with the carriage as above explained, has meshing engagement with the gear 12 over the full axial width of the teeth on gear 13.

The two plate cams 15, 16 are so designed that the punch holder 4 with the respective punches 5 is alternately disposed in one terminal position, and after the swinging movement of the punch holders, the other terminal position. The constant meshing relationship between the gears 12 and 13, taken with the full width engagement of the teeth on gear 13 with those of gear 12, excludes any damaging play in the moving parts during the swinging of the punch holders and the punches mounted thereon. Because of its extremely simple and strong construction, the punch change mechanism of the invention is entirely capable, by increasing the speed of driving of the mechanism, of improving the output of the press still further. Even under such conditions the wearing of the parts of the mechanism takes place at a very low rate.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. In a double pressure press having a pressure carriage supported by and reciprocable with respect to fixed structure, a punch holder plate on the carriage carrying two punches, the punch holder plate being cyclically movable in a plane at a substantial angle with respect to the direction of reciprocation of the carriage, and means for driving the carriage and the punch holder plate and for maintaining them in synchronism, the improved means for driving the carriage and the punch holder plate and for maintaining them in synchronism which comprises a drive train including a first spur gear rotatably mounted on the fixed structure with its longitudinal axis parallel to the direction of reciprocation of the carriage, a second spur gear rotatably mounted on the carriage for reciprocation therewith with respect to the first spur gear, the second spur gear having its axis parallel to the direction of reciprocation of the carriage, the teeth of one of the first and second spur gears over its entire axial length being constantly in mesh with the teeth of the other spur gear, and the means for driving the carriage and the punch holder plate and for maintaining them in synchronism includes means drivingly connecting the second spur gear with the punch plate holder.

2. The apparatus according to claim 1, wherein the first spur gear is axially elongated and is held from substantial axial movement with respect to the fixed structure, the second spur gear has an axial length which is substantially less than that of the first spur gear, and the teeth of the second spur gear over its entire axial length are constantly in mesh with the teeth of the first spur gear.

3. The apparatus according to claim 2, wherein the second spur gear is held from substantial axial movement with respect to the carriage.

4. Apparatus according to claim 2, wherein the axial length of the first spur gear exceeds the length of the stroke of the carriage.

5. Apparatus according to claim 1, wherein the dirve train includes a third spur gear which meshes with the first spur gear and imparts torque to the first spur gear for driving the punch holder plate.

6. Apparatus according to claim 1, wherein the punch plate holder is mounted on the carriage for movement with respect thereto in a plane at right angles to the direction of reciprocation of the carriage.

7. Apparatus according to claim 6, wherein the means for drivingly connecting the second spur gear with the punch plate holder includes cam means drivingly connected to the second spur gear, and cam follower means connected to the punch plate holder and cooperating with the cam means.

8. Apparatus according to claim 7, wherein the punch plate holder is mounted for oscillation with respect to the carriage, and the punches are mounted on a circle on the punch plate holder coaxial with the axis about which the punch plate holder oscillates.

* * * * *